US010032577B2

(12) United States Patent
Hsu et al.

(10) Patent No.: US 10,032,577 B2
(45) Date of Patent: Jul. 24, 2018

(54) ILLUMINATED KEYBOARD

(71) Applicant: Primax Electronics Ltd., Taipei (TW)

(72) Inventors: Chen-Hsuan Hsu, Taipei (TW); Che-Wei Yang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/421,837

(22) Filed: Feb. 1, 2017

(65) Prior Publication Data

US 2018/0166233 A1 Jun. 14, 2018

(30) Foreign Application Priority Data

Dec. 14, 2016 (TW) ..... 105141381 A

(51) Int. Cl.

| | |
|---|---|
| ***H01H 9/00*** | (2006.01) |
| ***H01H 13/83*** | (2006.01) |
| ***H01H 13/86*** | (2006.01) |
| ***H01H 13/14*** | (2006.01) |

(52) U.S. Cl.

CPC ..... *H01H 13/83* (2013.01); *H01H 13/14* (2013.01); *H01H 13/86* (2013.01); *H01H 2209/038* (2013.01); *H01H 2219/036* (2013.01); *H01H 2219/062* (2013.01); *H01H 2227/008* (2013.01); *H01H 2227/022* (2013.01); *H01H 2231/002* (2013.01)

(58) Field of Classification Search

CPC ..... H01H 13/83; H01H 13/14; H01H 13/86; H01H 2231/002; H01H 2227/022; H01H 2227/008; H01H 2219/062; H01H 2209/038; H01H 2219/036

USPC ..... 200/314

See application file for complete search history.

(56) References Cited

U.S. PATENT DOCUMENTS

| | | | | |
|---|---|---|---|---|
| 8,530,768 | B2 * | 9/2013 | Hwa | H01H 13/83 200/310 |
| 8,878,086 | B2 * | 11/2014 | Chen | H01H 13/83 200/310 |
| 2013/0087440 | A1 * | 4/2013 | Huang | H01H 3/125 200/314 |
| 2013/0233689 | A1 * | 9/2013 | Ng | H01H 13/85 200/5 A |
| 2015/0014136 | A1 * | 1/2015 | Liang | H01H 13/83 200/5 A |

* cited by examiner

*Primary Examiner* — Edwin A. Leon
*Assistant Examiner* — Lheiren Mae A Caroc
(74) *Attorney, Agent, or Firm* — Muncy, Geissler, Olds & Lowe, P.C.

(57) ABSTRACT

The present invention provides an illuminated keyboard, including a plurality of keys, a metal plate, a thin film circuit board, and a backlight module. The metal plate includes a plurality of metal domes, disposed below the keys, and correspondingly located above a plurality of electrical contact parts of the thin film circuit board. When a user presses each of the keys downward, the metal dome properly moves downward to get in contact with the corresponding electrical contact part to conduct the electrical contact part and generate a corresponding key signal. The backlight module is disposed below the thin film circuit board, and a plurality of light beams emitted from the backlight module is projected to the keys.

8 Claims, 6 Drawing Sheets

ILLUMINATED KEYBOARD

FIELD OF THE INVENTION

The present invention relates to a keyboard, and more particularly to an illuminated keyboard.

BACKGROUND OF THE INVENTION

A keyboard is an indispensable device to modern people for using a computer. A keyboard is provided with a lot of keys for a user to press to input an instruction.

With the improvement of keyboards, keyboards having backlight modules now appear, which are generally referred to as illuminated keyboards, the keyboards of this type are used in indoor lighting environments (for example, offices and rooms), and light rays that travel upward from bottoms of the keyboards to pass through each key can be obviously recognized by human eyes, so as to present visual effects.

A conventional illuminated keyboard includes a plurality of keys, a metal plate, and a thin film circuit board, and the metal plate bears the keys and the thin film circuit board. Therefore, the thin film circuit board needs a plurality of through holes for the keys to pass through to connect to the metal plate or for a plurality of connecting structures of the metal plate to pass through to connect to the keys. However, because a plurality of through holes needs to be formed on the thin film circuit board, and this processing procedure is complex and difficult and is not desired by a designer, an overall structure of a conventional illuminated keyboard still has room for improvement.

SUMMARY OF THE INVENTION

A main object of the present invention provides an illuminated keyboard, where a metal plate is disposed above a thin film circuit board, an electrical contact part on the thin film circuit board is conducted by pressing a metal dome on the metal plate, and in this way, the thin film circuit board does not need to be perforated, and the overall illuminated keyboard is thinned.

In accordance with a preferred implementation concept of the present invention, an illuminated keyboard is provided and includes:

a plurality of keys, each of the keys including:

a key cap; and a movable connecting component, disposed below the key cap and connected to the key cap;

a metal plate, disposed below the keys and bearing the keys, the metal plate including a plurality of metal domes, where each of the metal domes is protrudingly formed corresponding to one of the keys;

a thin film circuit board, disposed below the metal plate, where the thin film circuit board includes a plurality of electrical contact parts, the electrical contact parts are located on an upper surface of the thin film circuit board, and each of the electrical contact parts corresponds to one of the metal domes, so that when a user presses the key downward, the metal dome may move downward to get in contact with the corresponding electrical contact part to conduct the electrical contact part and generate a corresponding key signal; and a backlight module, disposed below the thin film circuit board, where the backlight module includes a light guide plate, a reflecting plate, and a plurality of illuminating components, the illuminating components emit a plurality of light beams toward the light guide plate, and the light beams are refracted by the light guide plate or reflected by the reflecting plate to the key cap.

In a preferred embodiment, each of the electrical contact parts includes an anode contact and a cathode contact, the anode contact is located at a central position of the electrical contact part, and the cathode contact is in a ring shape and encloses the anode contact, where when the metal dome is pressed downward, the metal dome gets in contact with the anode contact and the cathode contact at the same time, so as to conduct the anode contact and the cathode contact.

In a preferred embodiment, each of the metal domes presents a dome structure, and the dome structure includes at least one perforated region.

In a preferred embodiment, the movable connecting component is disposed between the key cap and the metal plate, the movable connecting component includes a first connecting end portion and a second connecting end portion, the first connecting end portion is movably connected to the bottom surface of the key cap, and the second connecting end portion is movably connected to the metal plate, where the movable connecting component is a scissors foot structure.

In a preferred embodiment, a plurality of metal hooks is protrudingly formed on the upper surface of the metal plate, and the second connecting end portions of the movable connecting components are hooked by the corresponding metal hooks.

In a preferred embodiment, the illuminated keyboard further includes a light-shielding layer, where the light-shielding layer is a coating layer, located between the thin film circuit board and the light guide plate, the coating layer is coated on a part of a lower surface of the thin film circuit board, and a plurality of translucent regions is formed on another part, which is not coated by the coating layer, of the lower surface of the thin film circuit board.

In a preferred embodiment, the illuminated keyboard further includes a light-shielding layer, located between the thin film circuit board and the light guide plate, where the light-shielding layer includes a transparent substrate and a coating layer, the coating layer is coated on a part of a lower surface of the transparent substrate, and a plurality of translucent regions is formed on another part, which is not coated by the coating layer, of the lower surface of the transparent substrate.

In a preferred embodiment, each of the key caps includes at least one light emergence region, the metal plate includes a plurality of through holes, and each of the light emergence regions is aligned with one of the through holes and one of the translucent regions, so that the light beams emitted from the illuminating components illuminate outward after passing through the translucent regions, the through holes, and the light emergence regions in sequence.

DETAILED DESCRIPTION OF THE PREFERRED EMBODIMENT

Figure 1:
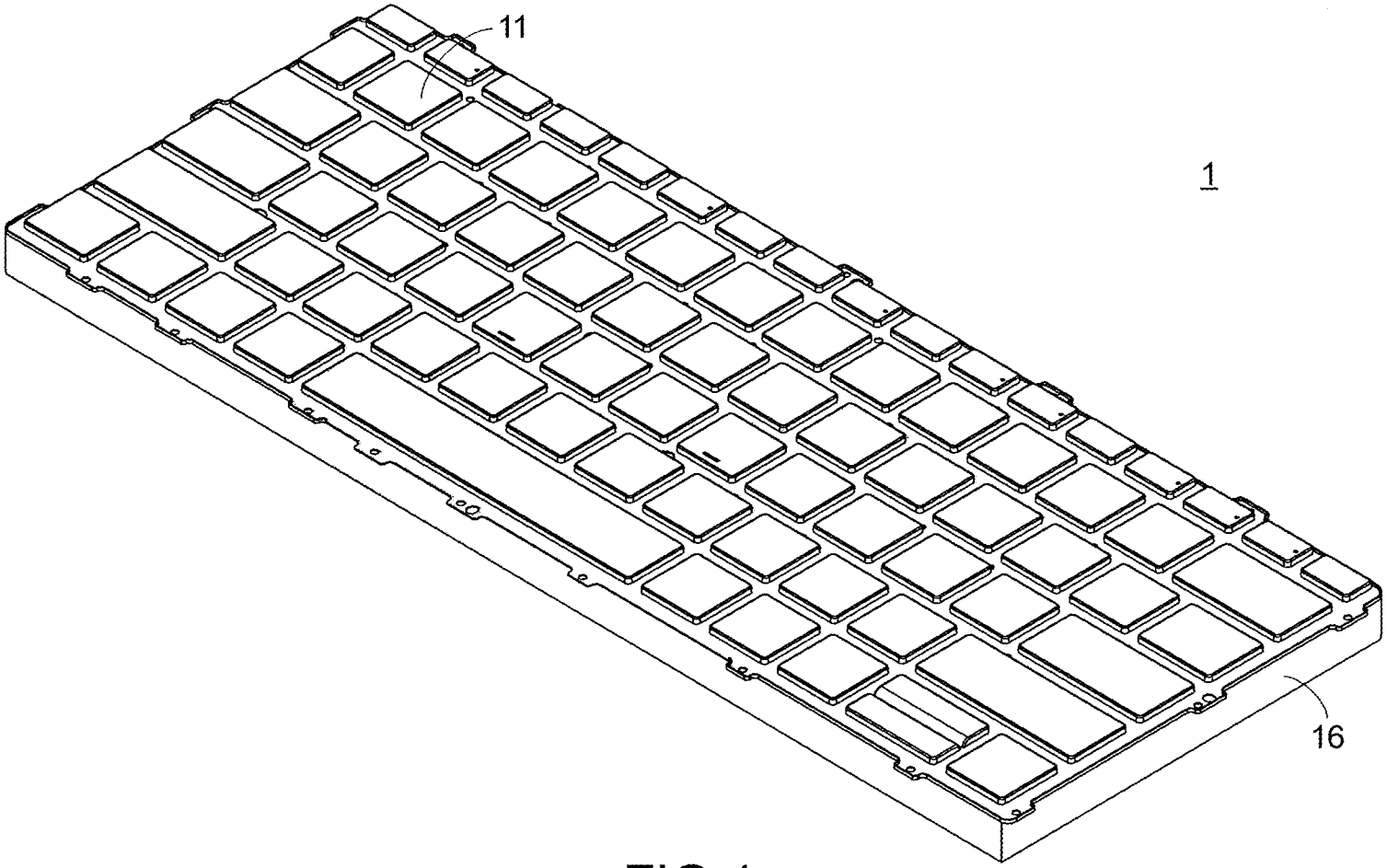
FIG. 1 is a schematic three-dimensional diagram of an illuminated keyboard according to the present invention.

Referring to FIG. 1, as shown in FIG. 1, FIG. 1 is a schematic three-dimensional diagram of an illuminated keyboard according to the present invention. An illuminated keyboard 1 of the present invention includes a plurality of keys 11 and a housing 16, where the housing 16 covers the plurality of keys 11, and presents an appearance of a conventional keyboard.

Figure 2:
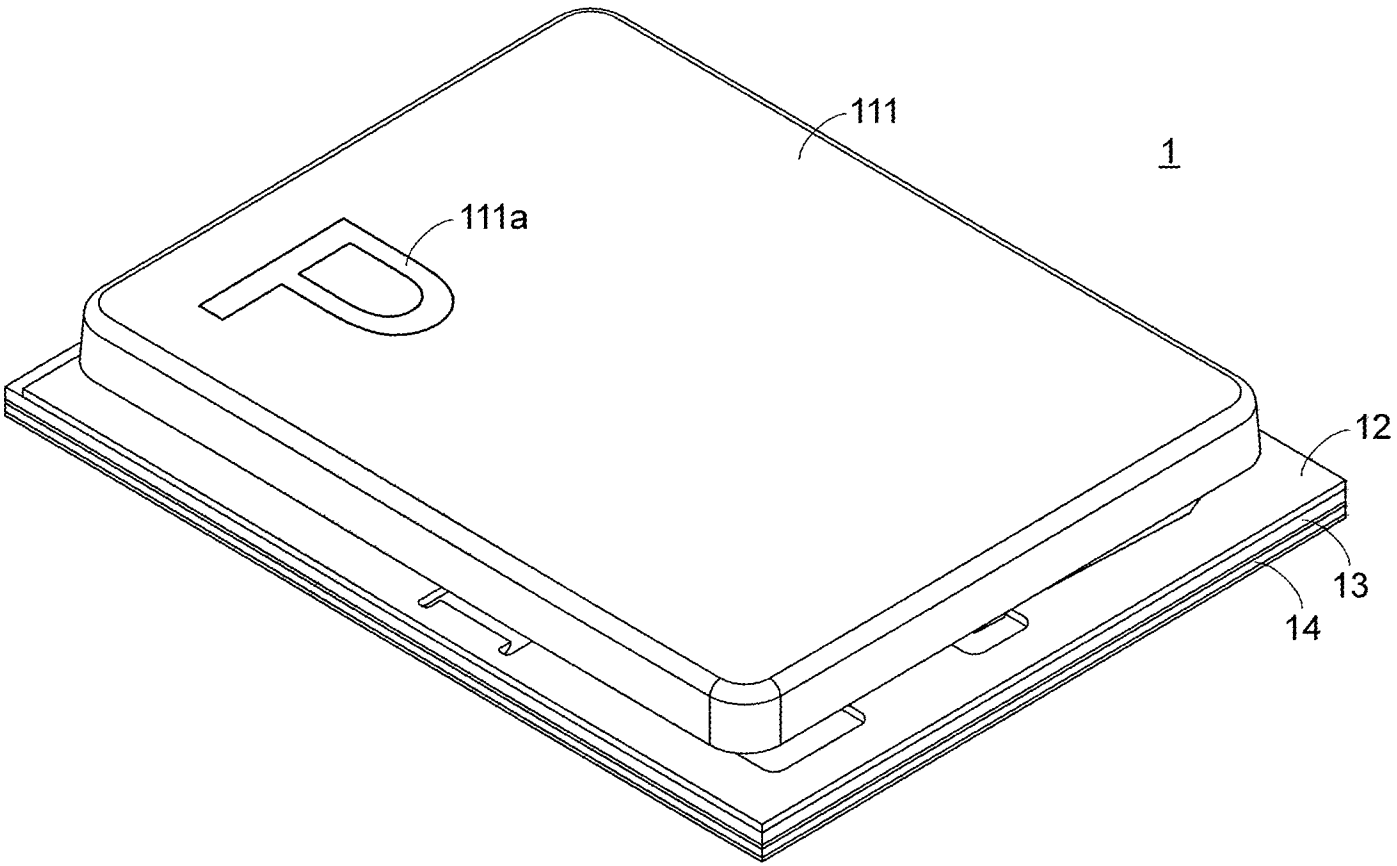
FIG. 2 is a schematic three-dimensional diagram of a single key of an illuminated keyboard according to a first embodiment of the present invention.
Figure 3:
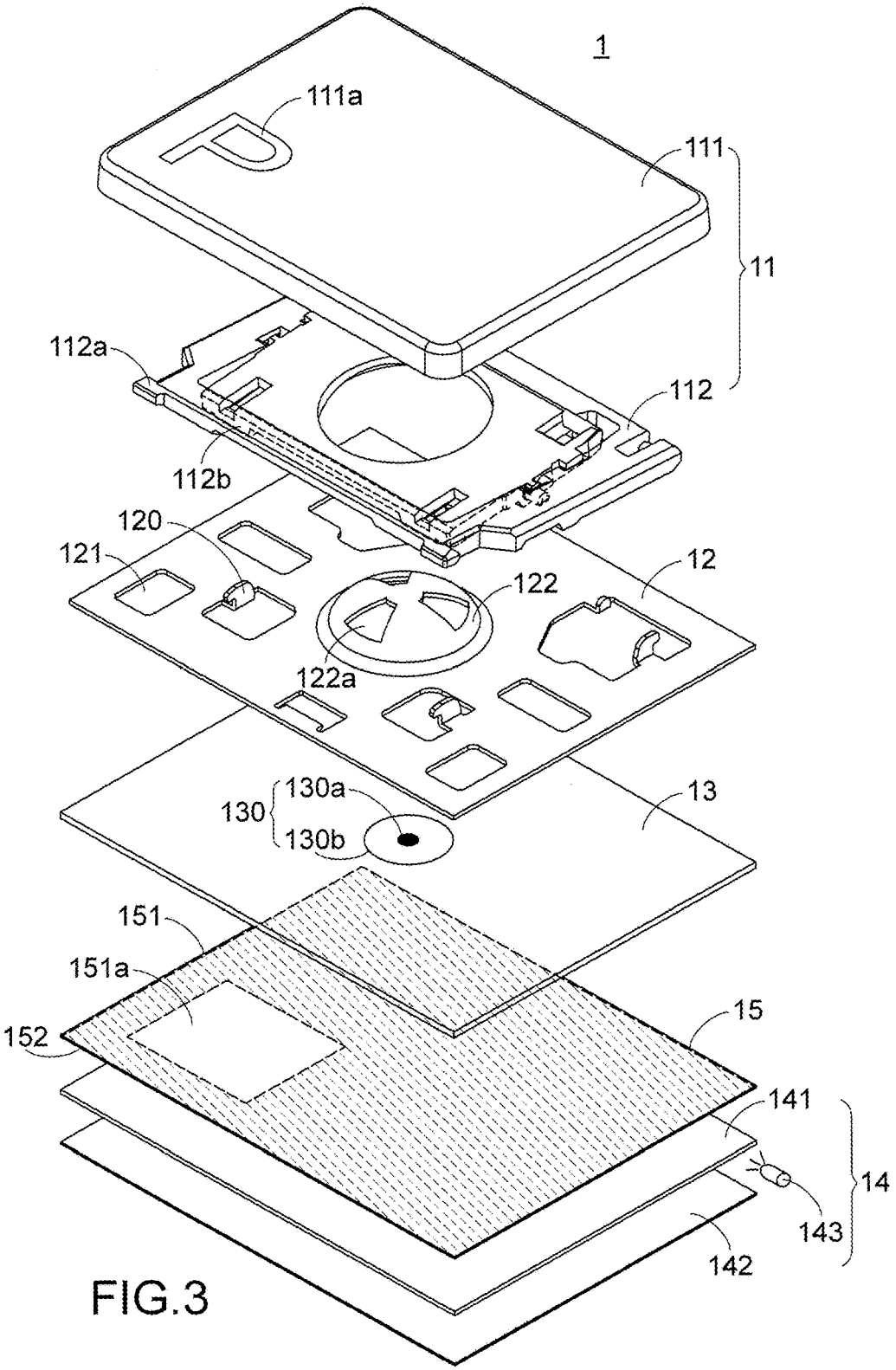
FIG. 3 is an exploded view of the single key of the illuminated keyboard according to the first embodiment of the present invention.

FIG. 2 is a schematic three-dimensional diagram of a single key of an illuminated keyboard according to a first embodiment of the present invention, and FIG. 3 is an exploded view of the single key of the illuminated keyboard according to the first embodiment of the present invention. Only a single key is shown in FIG. 2 and FIG. 3 for the reason describing facilely, and thereby only parts of a metal plate 12 and a thin film circuit board 13 are shown. But in practical terms, the metal plate 12 is a single-piece integrally-shaped metal plate 12 on which a plurality of keys disposed.

Referring to FIG. 2 and FIG. 3 in combination, the illuminated keyboard 1 of the present invention further includes a metal plate 12, a thin film circuit board 13, and a backlight module 14. A sequence of arranging components of the illuminated keyboard 1 of the present invention from the top to the bottom is: the keys 11, the metal plate 12, the thin film circuit board 13, and the backlight module 14. The metal plate 12 is disposed below the keys 11 to bear the keys 11, and the thin film circuit board 13 is disposed below the metal plate 12 to be pressed against and conducted by the metal plate 12. The metal plate 12 has a plurality of metal domes 122, the thin film circuit board 13 includes a plurality of electrical contact parts 130, and each of the metal domes 122 is aligned with one electrical contact part 130, and by means of such disposition, when a user presses the key 11, the key 11 pushes the metal dome 122 to conduct the electrical contact part 130.

Further, the metal dome 122 of the metal plate 12 is formed corresponding to each of the keys 11 in a manner of protruding upward, adapted to thrust against the key 11. The electrical contact part 130 is formed on an upper surface of the thin film circuit board 13, and the electrical contact part 130 is correspondingly located directly below each of the metal domes 122, by means of which when a user presses a key 11 downward, the key 11 properly pushes the metal dome 122 downward to get in contact with the corresponding electrical contact part 130 and conduct the electrical contact part 130, and thereby generate a corresponding key signal.

Figure 4:
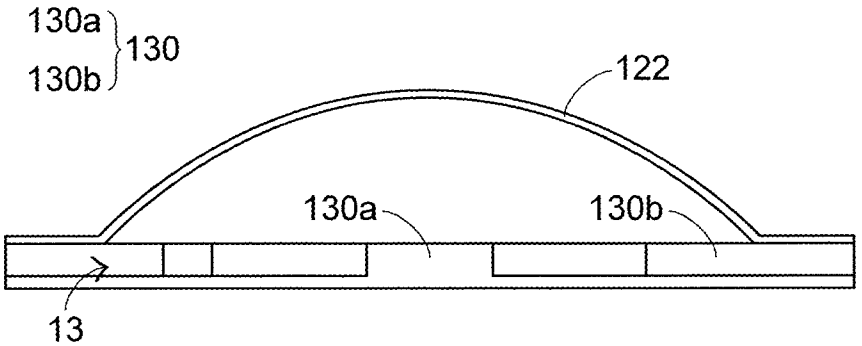
FIG. 4 is a sectional view of a metal plate and a thin film circuit board before a single key of the illuminated keyboard according to the first embodiment of the present invention is pressed.
Figure 5:
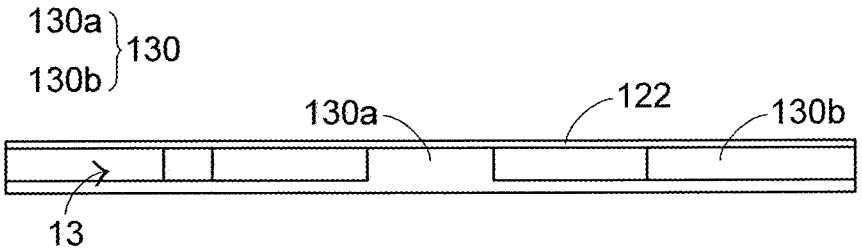
FIG. 5 is a sectional view of a metal and a thin film circuit board when a single key of the illuminated keyboard according to the first embodiment of the present invention is pressed.

FIG. 4 is a sectional view of a metal plate and a thin film circuit board before a single key of the illuminated keyboard according to the first embodiment of the present invention is pressed, and FIG. 5 is a sectional view of a metal and a thin film circuit board when a single key of the illuminated keyboard according to the first embodiment of the present invention is pressed, and FIG. 4 and FIG. 5 should be referred to in combination. The metal dome 122 of the illuminated keyboard 1 of the present invention presents a dome structure, and the dome structure protrudes toward the key 11, so as to be pressed by the key 11 from the top. Further, each of the electrical contact parts 130 includes an anode contact 130*a* and a cathode contact 130*b*, the anode contact 130*a* is located at a central position of the electrical contact part 130, and the cathode contact 130*b* is in a ring shape and encloses the anode contact 130*a*, where when the metal dome 122 is pressed downward, the metal dome 122 gets in contact with the anode contact 130*a* and the cathode contact 130*b* at the same time, so as to conduct the anode contact 130*a* and the cathode contact 130*b*, thereby generating the corresponding key signal.

In a preferred implementation manner of the present invention, the dome structure includes at least one perforated region 122*a* (referring to FIG. 3), and the purpose of existence of the perforated region 122*a* is to facilitate shaping without stress concentration when the metal dome 122 is manufactured into a shape of the dome structure.

Further referring to FIG. 2 and FIG. 3, keys of the illuminated keyboard 1 of the present invention are described in the following. Each of the keys 11 includes a key cap 111 and a movable connecting component 112, the movable connecting component 112 may be a common scissors foot structure, and the movable connecting component 112 is disposed between the key cap 111 and the metal plate 12. The movable connecting component 112 includes a first connecting end portion 112*a* and a second connecting end portion 112*b*, the first connecting end portion 112*a* is movably connected to the bottom surface of the key cap 111, and the second connecting end portion 112*b* is movably connected to the metal plate 12. Preferably, the first connecting end portion 112*a* is hooked by a key cap hook (not shown in the drawing) of the bottom surface of the key cap 111, and the second connecting end portion 112*b* is hooked by a metal hook 120 that is protrudingly formed on the upper surface of the metal plate 12.

Besides, the backlight module 14 of the present invention is disposed below the thin film circuit board 13. The backlight module 14 includes a light guide plate 141, a reflecting plate 142, and a plurality of illuminating components 143, the illuminating components 143 emit a plurality of light beams toward the light guide plate 141, the light beams are refracted by the light guide plate 141 upward in a direction toward the thin film circuit board 13/metal plate 12/key cap 111 or is reflected by the reflecting plate 142 upward in a direction toward the thin film circuit board 13/metal plate 12/key cap 111.

On the other hand, the illuminated keyboard 1 of the present invention further includes a light-shielding layer 15, located between the thin film circuit board 13 and the light guide plate 141, where the light-shielding layer 15 includes a transparent substrate 151 and a coating layer 152, the coating layer 152 is coated on a partial region of a lower surface of the transparent substrate 151, this partial region is a light-shielded region to prevent light from passing through the partial region, and another partial region, which is not coated by the coating layer 152, of the lower surface of the transparent substrate 151 is a light-unshielded region 151*a*, through which light can pass.

Each key cap 11 includes at least one light emergence region 111*a*, the metal plate 12 includes a plurality of through holes 121, and each light emergence region 111*a* is aligned with a through hole 121 and a light-unshielded region 151*a*, so that the light beams emitted from the illuminating components 143, after entering the light guide plate 141, illuminate outward after passing through the light-unshielded region 151*a*, the through hole 121, and the light emergence region 111*a* in sequence. The light emergence region 111*a* described herein is presented on the key cap 111 as a pattern such as a letter, a character, or a symbol.

Figure 6:
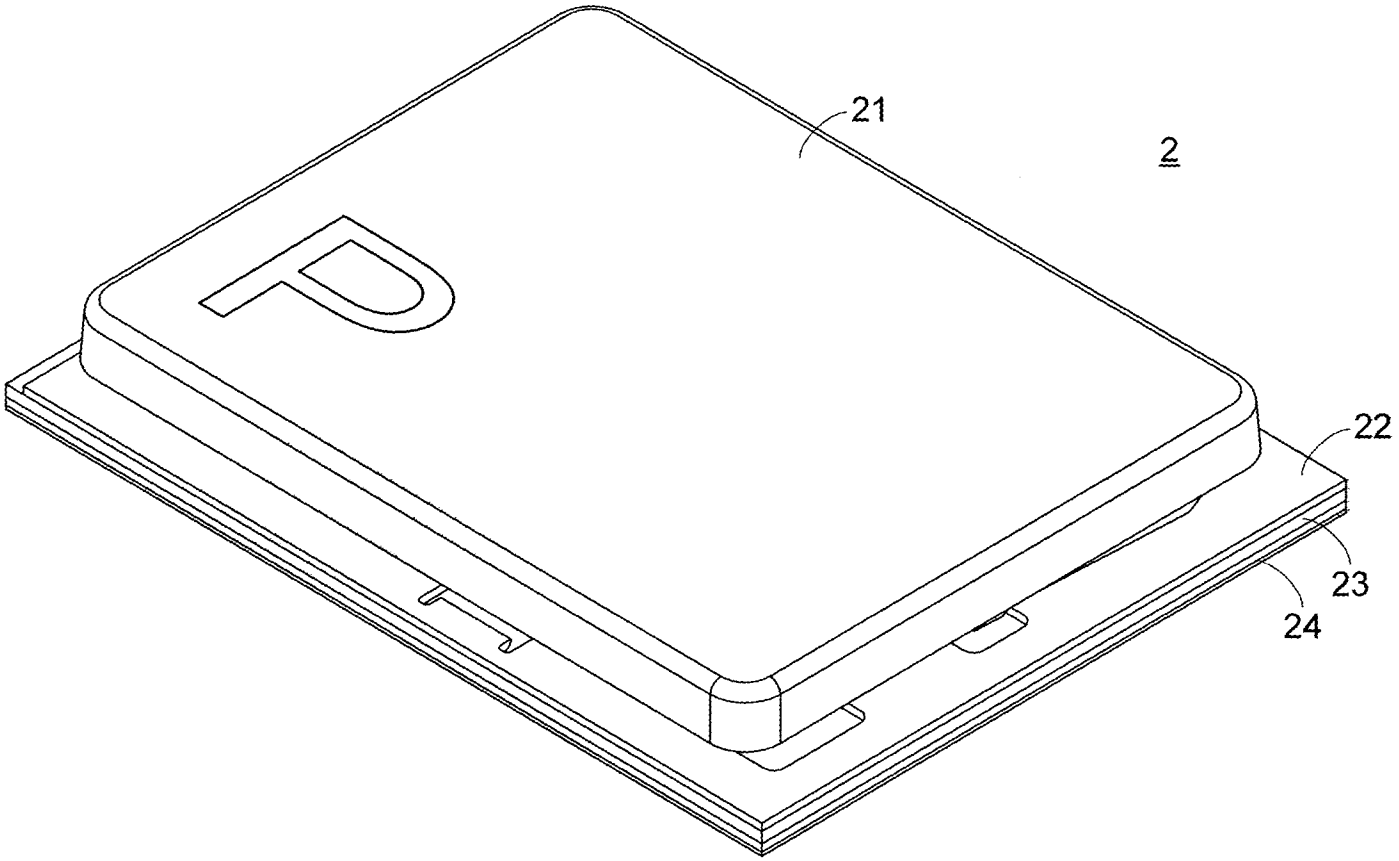
FIG. 6 is a schematic three-dimensional diagram of a single key of an illuminated keyboard according to a second embodiment of the present invention.
Figure 7:
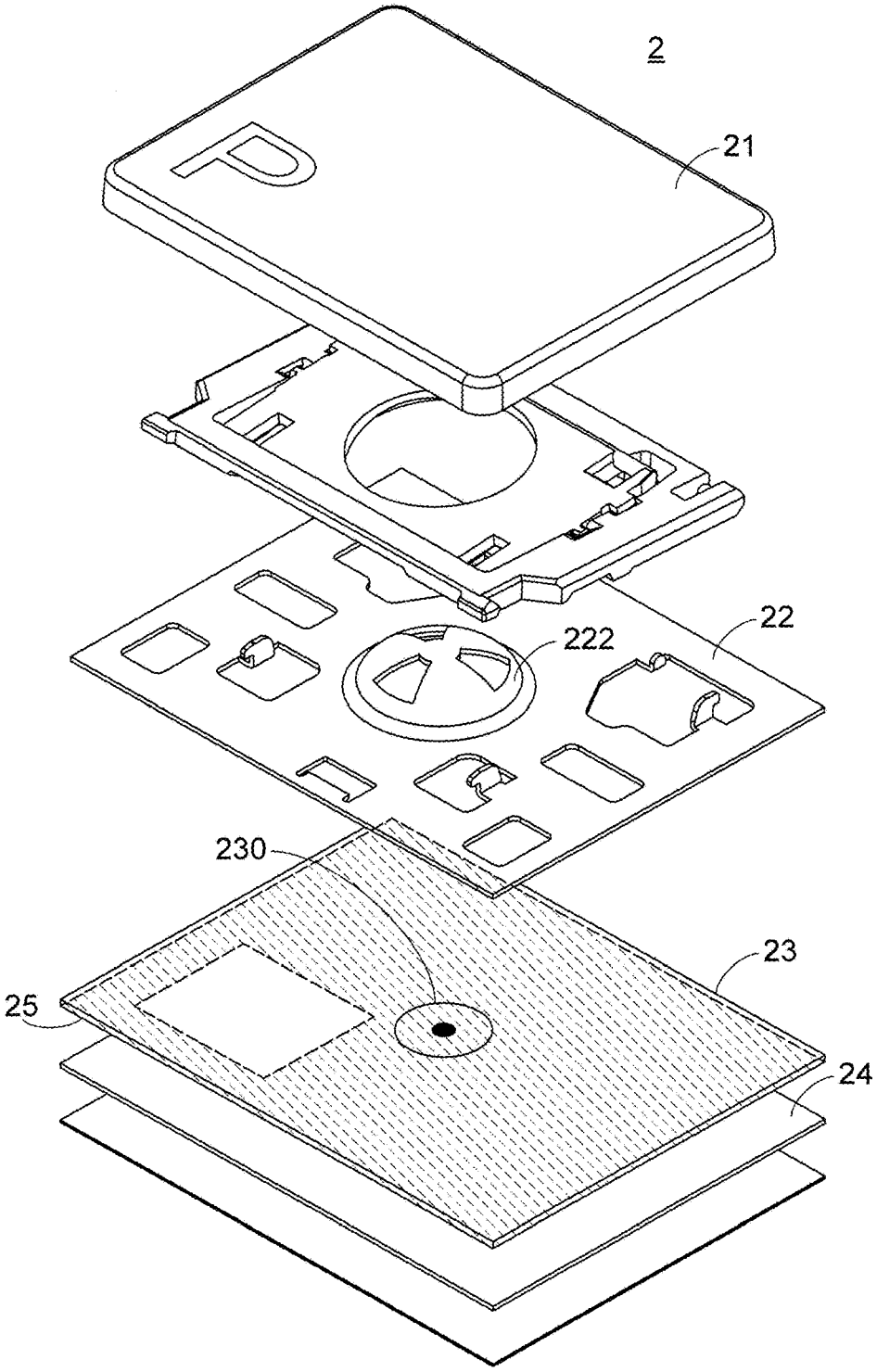
FIG. 7 is an exploded view of the single key of the illuminated keyboard according to the second embodiment of the present invention.

Further referring to FIG. 6 and FIG. 7, FIG. 6 is a schematic three-dimensional diagram of a single key of an illuminated keyboard according to a second embodiment of the present invention; and FIG. 7 is an exploded view of the single key of the illuminated keyboard according to the second embodiment of the present invention. The second embodiment is similar to the first embodiment, an illuminated keyboard 2 of the second embodiment of the present invention includes a plurality of keys 21, a metal plate 22, a thin film circuit board 23, and a backlight module 24, the metal plate 22 is disposed below the key 21 to bear the keys 21, and the thin film circuit board 23 is disposed below the metal plate 22 to be pushed and conducted by the metal plate 22. By means of such disposition, when a user presses a key 21, the key 21 pushes a metal dome 222 to conduct an electrical contact part 230.

A difference distinguishing the illuminated keyboard of the second embodiment from the first embodiment is that a light-shielding layer 25 of the illuminated keyboard 2 of the second embodiment is directly coated on a partial region of a lower surface of the thin film circuit board 23, this partial region is a light-shielded region, through which light would not pass, and another partial region, which is not coated by a coating layer 25, of the lower surface of the thin film circuit board 23 is a light-unshielded region 25*a*, through which light could pass. In other words, as compared with the illuminated keyboard 1 of the first embodiment, the illuminated keyboard 2 of the second embodiment omits disposition of a transparent substrate, which is more beneficial to thinning the illuminated keyboard.

In conclusion, a key of the illuminated keyboard of the present invention directly pushes a metal dome of the integrally-shaped metal plate to conduct an electrical contact part of a thin film circuit board below the metal plate, so as to generate a key signal. By means of such disposition, it is equivalent to that the metal plate not only has a supporting function, but also has an electrically connecting function, so that the illuminated keyboard can be manufactured more simply and conveniently. In addition, it is also unnecessary to open an extra hole on the thin film circuit board.

The foregoing embodiments merely illustratively describe the principles and effects of the present invention and explain technical features of the present invention instead of limiting the protection scope of the present invention. All the changes or equivalent arrangements that can be easily completed by persons skilled in the art without departing from the technical principles and spirit of the present invention fall within the scope claimed by the present invention. Therefore, the protection scopes of the present invention are listed as the following claims.

What is claimed is:

1. An illuminated keyboard, comprising:

a plurality of keys, each of the keys comprising:

a key cap; and a movable connecting component, disposed below the key cap and connected to the key cap;

a metal plate, disposed below the keys and bearing the keys, the metal plate comprising a plurality of metal domes, wherein each of the metal domes is protrudingly formed corresponding to one of the keys;

a thin film circuit board, disposed below the metal plate, wherein the thin film circuit board comprises a plurality of electrical contact parts, the electrical contact parts are located on an upper surface of the thin film circuit board, and each of the electrical contact parts corresponds to one of the metal domes, so that when a user presses the key downward, the metal dome may move downward to get in contact with the corresponding electrical contact part to conduct the electrical contact part and generate a corresponding key signal; and a backlight module, disposed below the thin film circuit board, wherein the backlight module comprises a light guide plate, a reflecting plate, and a plurality of illuminating components, the illuminating components emit a plurality of light beams toward the light guide plate, and the light beams are refracted by the light guide plate or reflected by the reflecting plate to the key cap, wherein each of the electrical contact parts comprises an anode contact and a cathode contact, the anode contact is located at a central position of the electrical contact part, and the cathode contact is in a ring shape and encloses the anode contact, wherein when the metal dome is pressed downward, the metal dome gets in contact with the anode contact and the cathode contact at the same time, so as to conduct the anode contact and the cathode contact.

2. The illuminated keyboard according to claim 1, wherein each of the metal domes presents a dome structure, and the dome structure comprises at least one perforated region.

3. The illuminated keyboard according to claim 1, wherein the movable connecting component is disposed between the key cap and the metal plate, the movable connecting component comprises a first connecting end portion and a second connecting end portion, the first connecting end portion is movably connected to the bottom surface of the key cap, and the second connecting end portion is movably connected to the metal plate, wherein the movable connecting component is a scissors foot structure.

4. The illuminated keyboard according to claim 3, wherein a plurality of metal hooks are protrudingly formed on an upper surface of the metal plate, and the second connecting end portions of the movable connecting components are hooked by the corresponding metal hooks.

5. The illuminated keyboard according to claim 1, further comprising a light-shielding layer, wherein the light-shielding layer is a coating layer, located between the thin film circuit board and the light guide plate, the coating layer is coated on a part of a lower surface of the thin film circuit board, and a plurality of translucent regions is formed on another part, which is not coated by the coating layer, of the lower surface of the thin film circuit board.

6. The illuminated keyboard according to claim 5, wherein each of the key caps comprises at least one light emergence region, the metal plate comprises a plurality of through holes, and each of the light emergence regions is aligned with one of the through holes and one of the translucent regions, so that the light beams emitted from the illuminating components illuminate outward after passing through the translucent regions, the through holes, and the light emergence regions in sequence.

7. The illuminated keyboard according to claim 1, further comprising a light-shielding layer, located between the thin film circuit board and the light guide plate, wherein the light-shielding layer comprises a transparent substrate and a coating layer, the coating layer is coated on a part of a lower surface of the transparent substrate, and a plurality of translucent regions is formed on another part, which is not coated by the coating layer, of the lower surface of the transparent substrate.

8. The illuminated keyboard according to claim 7, wherein each of the key caps comprises at least one light emergence region, the metal plate comprises a plurality of through holes, and each of the light emergence regions is aligned with one of the through holes and one of the translucent regions, so that the light beams emitted from the illuminating components illuminate outward after passing through the translucent regions, the through holes, and the light emergence regions in sequence.

* * * * *